US005306416A

United States Patent [19]

Le et al.

[11] Patent Number: 5,306,416

[45] Date of Patent: Apr. 26, 1994

[54] PROCESS FOR MAKING A BLENDED LUBRICANT

[75] Inventors: Quang N. Le, Cherry Hill, N.J.; Stephen S. Wong, Astrid Meadows, Singapore

[73] Assignee: Mobil Oil Corporation, Fairfax, Va.

[21] Appl. No.: 898,365

[22] Filed: Jun. 15, 1992

[51] Int. Cl.[5] ..... C10G 71/00; C10M 171/02; C10M 129/22

[52] U.S. Cl. ..... 208/108; 208/18; 208/19; 208/28; 252/55

[58] Field of Search ..... 208/108, 18, 19, 28; 252/55

[56] References Cited

U.S. PATENT DOCUMENTS

| | | | |
|---|---|---|---|
| 3,128,246 | 4/1964 | Oberright et al. | 208/255 |
| 3,594,320 | 7/1971 | Orkin | 252/59 |
| 4,594,172 | 6/1986 | Sie | 252/55 |
| 4,618,737 | 10/1986 | Chester et al. | 585/329 |
| 4,913,794 | 4/1990 | Le et al. | 208/18 |
| 5,021,142 | 6/1991 | Bortz et al. | 208/58 |
| 5,037,528 | 8/1991 | Garwood et al. | 208/27 |

OTHER PUBLICATIONS

ASTM D341-87 "Standard Viscosity-Temperature Charts For Liquid Petroleum Products", May (1987).

ASTM D2270-86 "Standard Practice For Calculating Viscosity Index from Kinematic Viscosity at 40 and 100°C.".

*Oil Viscosity and Temperature,* Chapter 5, pp. 109-110.

*Primary Examiner*—R. Bruce Breneman
*Assistant Examiner*—P. L. Hailey
*Attorney, Agent, or Firm*—Alexander J. McKillop; Malcolm D. Keen; Jessica M. Sinnott

[57] ABSTRACT

A blended mineral oil lubricant is made having a higher viscosity index than predicted by calculating the viscosity index from an ASTM standard method designated D 341-87 or by calculating the average of the actual VI based on the proportion of each component of the blend. The lubricant is treated with a peroxide compound, preferably an organic peroxide such as di-tertiary butyl peroxide to increase the viscosity index. The treated lubricant is blended with a lubricant of lower viscosity index to achieve a blended lubricant having an enhanced viscosity index. The lubricant charge stock and blending component can be a wax-derived lubricant fraction or a conventional light neutral or heavy neutral mineral oil.

20 Claims, 3 Drawing Sheets

PROCESS FOR MAKING A BLENDED LUBRICANT

FIELD OF THE INVENTION

The present invention relates to the production of a blended lubricant having an enhanced viscosity index. The process includes treating a lubricant with a peroxide compound to produce a higher viscosity lubricant and blending the treated higher viscosity lubricant with another lubricant to produce a blended lubricant having an actual viscosity index greater than predicted by mathematical rules of blend viscosities.

BACKGROUND OF THE INVENTION

Refinery economics encourage full utilization of a broad spectrum of feedstocks for lubricant refining even though the lower quality feeds are more difficult, if not impossible, to process into quality products. Blending materials of higher quality with materials of lower quality to produce a lubricant meeting predetermined specifications accomplishes full use of a more complete range of products.

The quality of a hydrocarbon feedstock destined for lubricant refining impacts the final lubricant properties including the boiling point, viscosity, viscosity index (VI), pour point and other properties.

The pour point is the lowest temperature at which the stock will flow, while the measurement of viscosity indicates the lubricant's resistance to flow which tends to thin or decrease as the temperature increases and thicken or increase as the temperature decreases. The amount of thinning is critical to lubricant performance because it impacts the ability to lubricate successfully at high temperatures. Thus, it is important to know how fast the lubricant decreases in viscosity as the temperature goes up and the Viscosity Index (VI) is a measurement of this effect. There is a trend towards more severe service ratings as engines become more efficient leading to higher engine temperatures. This requires higher V. I. to ensure that the lubricants will have adequate viscosity at high temperatures without excessive viscosity at lower temperatures. In part, these essential properties may be improved by additives but advances are needed in basestock performance to accommodate more severe service requirements.

The feedstock dictates the choice of refining process since all refining processes are not suitable for all types of feedstocks. Although many lubricant refining processes have been proposed for preparing lubricants and improving their properties; in general, lower quality feedstocks require more severe treatment to produce a suitable product meeting the minimum service specifications. Since refinery economics often dictate using a lower quality feedstock for lubricant refining, there is a need for processes which enable the refiner to obtain higher quality lubricants from low quality lubricant feedstocks under less severe, and less costly, process conditions. Low severity process conditions translate to a more valuable commodity at a lower cost.

The starting point for producing mineral oil lubricants is in the atmospheric or vacuum distillation tower. Distillation separates the crude oil into different components by their boiling range. The lubricant boiling range fraction, which boils above about 650° F., makes the charge stock for lubricant refining. The components of the lubricant charge stock include paraffins, naphthenes, aromatics, resins and asphaltenes. The paraffinic and naphthenic distillate fractions are generally referred to as the neutrals, e.g. heavy neutral and light neutral. Although the heavy neutral is characterized by a higher percentage of naphthenes and the light neutral is characterized by a higher percentage paraffins, both contain some aromatics along with some paraffins and naphthenes. Because the aromatic components lead to high viscosity and extremely poor viscosity indices, highly aromatic asphaltic type crudes are not the preferred feedstocks. The resins and alphaltenes are undesirable because they are too viscous and contain high levels of metals and sulfur. The paraffinic and naphthenic crude stocks are preferred yet their lubricant qualities conflict. The more paraffinic stocks make good lubricants because they possess excellent viscosity properties, yet the long straight chain paraffinic component encourages an undesirably high pour point. On the other hand, the naphthenic stocks have the desirable low pour point but have poor viscosity properties.

To produce an effective high performance lubricant, the differences between the lower pour point more paraffinic stocks and the deficient viscosity properties of the aromatic and naphthenic stocks must be reconciled. This is achieved by subjecting the feedstock to various refining processes which physically separate the undesirable components and/or chemically convert the undesirable components to more desirable components.

Since aromatics are present to varying degrees in paraffinic and naphthenic stocks, their removal is necessary to obtain optimum lubricant properties. The aromatics are extracted by solvent extraction using a solvent such as phenol, furfural, N-methylpyrolidone or another material which is selective for the extraction of the aromatic components. After solvent extraction, the paraffinic stocks are usually subjected to a dewaxing step to remove the waxy paraffinic components which contribute to the high pour point. The dewaxing step is usually the last major step in the lubricant refining process.

A number of dewaxing processes are known in the petroleum refining industry. One of these, solvent dewaxing with solvents such as methylethylketone (MEK) and liquid propane, has achieved the widest use in the industry. MEK is a solvent for the naphthenic component and the highly branched paraffinic component which has adequate pour point properties. Solvent dewaxing leaves behind the high pour point waxy component (the long straight chain paraffins) in the form of a solid which can be filtered. This solid is called slack wax.

Recently, catalytic dewaxing processes have been proposed for the production of lubricating oil stocks and these processes possess a number of advantages over the conventional solvent dewaxing procedures. The catalytic dewaxing processes are generally similar to processes for dewaxing the middle distillate fractions such as heating oils, jet fuels and kerosenes. The Mobil Lube Oil Dewaxing Process (MLDW) has now reached maturity and is capable of producing low pour point oils not attainable by solvent dewaxing.

Generally, the catalytic dewaxing processes operate by selectively cracking the longer chain end paraffins to produce lower molecular weight products which may then be removed by distillation from the higher boiling lubricant stock. The catalysts which have been proposed for this purpose have usually been zeolites which have a pore size which admits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, and the synthetic ferrierites ZSM-35 and ZSM-38 have been proposed for this purpose in dewaxing processes, as described in U.S. Pat. Nos. 3,894,938, 4,176,050, 4,181,598, 4,222,855, 4,229,282 and 4,247,388. A dewaxing process employing synthetic offretite is described in U.S. Pat. No. 4,259,174. The relationship between zeolite structure and dewaxing properties is discussed in J. Catalysis 86, 24–31 (1984).

The conventional catalytic dewaxing processes using intermediate pore size zeolites, such as ZSM-5 can cause a yield loss since the components which are in the desired boiling range undergo a bulk conversion to lower boiling fractions. Although the lower boiling fractions may be useful in other products, they must be removed from the lubricant stock. A notable advance in the dewaxing process is described in U.S. Pat. Nos. 4,419,220 and 4,518,485, in which the waxy components of the feed, comprising straight chain and slightly branched chain paraffins, are converted by isomerization over a catalyst based on zeolite beta and a hydrogenation-dehydrogenation component which is typically a base metal or a noble metal, usually of group VIA or VIIIA of the Periodic Table of the Elements such as cobalt, molybdenum, nickel, tungsten, palladium or platinum. During the isomerization, the waxy components are converted to relatively less waxy isoparaffins and at the same time, the slightly branched chain paraffins undergo isomerization to more highly branched aliphatics. Some cracking does take place so that not only is the pour point reduced by reason of the isomerization but, in addition, the heavy ends undergo some cracking or hydrocracking to form liquid range materials which contribute to a low viscosity product. As described in U.S. Pat. No. 4,518,485, the isomerization dewaxing step may be proceeded by a hydrotreating step in order to remove heteroatom-containing impurities, which may be separated in an interstage separation process similar to that employed in two-stage hydrotreating-hydrocracking processes.

Although the catalytic dewaxing processes are commercially important because they do not produce quantities of solid paraffin wax which is a less desirable, low value product, some have certain disadvantages. Because of the disadvantages, combining the catalytic dewaxing processes with other processes in order to produce lube stocks of satisfactory properties has been proposed. For example, U.S. Pat. No. 4,181,598 discloses a method for producing a high quality lubricant base stock by subjecting a waxy fraction to solvent refining, followed by catalytic dewaxing with subsequent hydrotreatment of the product. U.S. Pat. No. 4,428,819 discloses a process for improving the quality of catalytically dewaxed lubricant stocks by subjecting the catalytically dewaxed oil to a hydroisomerization process which removes residual quantities of petrolatum wax which contribute to poor performance in the Overnight Cloud Point test (ASTM D2500-66).

The use of peroxide treatment for modifying the viscosity of various lubestocks including distillates and hydrocracked resids has been described in U.S. Pat. Nos. 3,128,246 and 3,594,320. Other peroxide treatment processes are described in U.S. Pat. Nos. 4,594,172 and 4,618,737. Peroxide treatment has been suggested for coupling or dimerization of Fischer-Tropsch paraffins. In U.S. Patent No. 4,594,172 a synthesis gas conversion process is described in which the synthesis gas is converted to paraffins by Fischer-Tropsch. The resulting $C_{10}$ to $C_{19}$ fraction is given two peroxide treatments to couple the paraffins and produce a $C_{20}+$ wax fraction.

In U.S. Patent No. 5,037,528 there is described a process for making high VI lubricant base stocks by the peroxide-promoted oligomerization of wax-derived lubricant fractions, such as a slack wax or deoiled wax. Because the increase in viscosity is related to the amount of peroxide used with greater viscosity increases resulting from greater amounts of peroxide, the peroxide requirements for this process depend on the desired increase in viscosity. The peroxide requirements are on the order of about 1 to 50, preferably from 4 to 20 weight percent of the oil. This relationship, between the proportion of peroxide used and the viscosity increase, is essentially exponential both in the batch and continuous reaction. The process is exceedingly efficient in its use of peroxide; that is, large amounts of peroxide are unnecessary to achieve efficient coupling of the paraffinic components to produce the higher molecular weight oligomers. The described coupling can be achieved by the use of 10 o 20 wt. % peroxide as opposed to 100 weight % peroxide described in U.S. Pat. No. 4,594,172 which is a significant economic savings. U.S. Pat. No. 5,037,528 is incorporated herein by reference in its entirety.

Lubricant blending is one of the last steps in the manufacture of a lubricant and is employed to meet viscosity and VI requirements. Lubricant blending comprises mixing different materials boiling in the lubricant boiling range to make a final homogenous product. Usually a higher viscosity lubricant will be blended with a lower viscosity lubricant to achieve a blended lubricant of intermediate viscosity. The viscosity properties of the blended lubricant can usually be predicted by a blending relationship which has been accepted as a standard by the American Society for Testing and Materials (ASTM) designation D 341-87.

The ASTM D 341-87 adopted kinematic viscosity-temperature charts as a convenient method for ascertaining the kinematic viscosity of a liquid hydrocarbon at any temperature within a range, provided that kinematic viscosities at two temperatures are known. The charts are based on the following mathematical relationship:

$$\log \log Z = A - B \log T$$

wherein $Z = (v + 0.7 + C - D + E - F + G - H)$;
$v =$ kinematic viscosity, cSt.;
$T =$ temperature, K or °R;
$A = \log \log Z_{B(40)}$;
$B = \log \log Z_{B(100)}$;
$C = \log \log Z_{L(40)}$;
$D = \log \log Z_{L(100)}$;
$E = \log \log Z_{H(40)}$;
$F = \log \log Z_{H(100)}$;
$B =$ blend;
$L =$ low viscosity oil;
$H =$ high viscosity oil;
$(40) = 40°$ C.; and
$(100) = 100°$ C.

The viscosity characteristics of lubricant blends based on predictions or estimations arrived at from the ASTM method are usually relied on in evaluating whether a particular blend will meet the necessary kinematic viscosity and VI specifications or the target kinematic viscosity and VI. This blending relationship between oils is further described in appendixes Xl amd X2 of ASTM D 341-87. Although the ASTM method is not the only available test for approximating the viscosity of a blend of oils, it is a widely accepted standard. From the calculation of the viscosity according to the ASTM method, the VI can be calculated using the ASTM D2270-86 standard method for calculating viscosity index. The actual VI is also calculated from the ASTM D2270-86 method using the actual kinematic viscosities of the lubricant measured at 40° C. and 100° C.

Another lubricant blending rule is the Arrhenius Rule where:

$$\log n_o = \frac{V_1}{V}\log n_1 + \frac{V_2}{V}\log n_2$$

where:

$n_o$ is the viscosity of the blend, $n_1$ and $n_2$ are the viscosities of the component oils;

$V_1$ and $V_2$ are the volumes of the oils making up the blend; and

V is the volume of the blend.

Although the Arrhenius Rule was established for dynamic viscosities, it can be extended to cover kinematic viscosities.

SUMMARY OF THE INVENTION

The invention is directed to a process for making a blended lubricant having a higher viscosity and viscosity index than predicted by standard blending rules. More importantly, the invention enables the refiner to obtain a high quality good viscosity blended lubricant from a low quality lubricant feedstock at a lower peroxide dosage which translates to the production of a more valuable commodity at a lower cost.

A feature of the invention is to treat a mineral oil with a peroxide compound to produce a high viscosity index lubricant followed by blending the high viscosity index lubricant with a lower viscosity index lubricating oil to produce a blended lubricant with an unexpectedly enhanced viscosity index.

The invention provides a process for producing a blended lubricant of enhanced viscosity and viscosity index which comprises treating a hydrocarbon fraction with an organic peroxide and blending the peroxide treated fraction with a hydrocarbon fraction to produce a blended lubricant with a higher viscosity and viscosity index than predicted by the standard blending rules. Thus the invention is directed to a process for making a blended lubricant of enhanced viscosity index comprising the steps of:

treating a first lubricant boiling range material with an amount of an organic peroxide sufficient to increase the viscosity index of the lubricant boiling range material;

blending from about 5 to 95 wt. % of the treated lubricant boiling range material with from about 95 to 5 wt. % of a second lubricant boiling range material to produce a blended lubricant having a higher viscosity index than predicted by calculating the viscosity index using an ASTM standard method designated D 341-87 and by calculating the average of the VI based on the proportion of each component of the blend.

The invention is also concerned with an improved method of making a blended extra high viscosity index (XHVI) lubricant. Specifically, the invention is an improvement upon the method of making a high viscosity index lubricant by the peroxide oligomerization of a wax-derived lubricant which is disclosed in U.S Pat. No. 5,037,528. This improvement is in the lower peroxide dosage needed to meet the target viscosity and viscosity index.

Thus, according to the present invention there is provided a process for producing a blended lubricant of enhanced viscosity index which comprises catalytically dewaxing a petroleum wax and subjecting the dewaxed product to treatment with an organic peroxide to increase its viscosity index and blending the treated lubricant with a dewaxed lubricant or a mineral oil lubricant of lower viscosity index to produce a lubricant of higher viscosity index than that predicted by the linear blending relationship.

DETAILED DESCRIPTION

Feedstock

Figure 1:
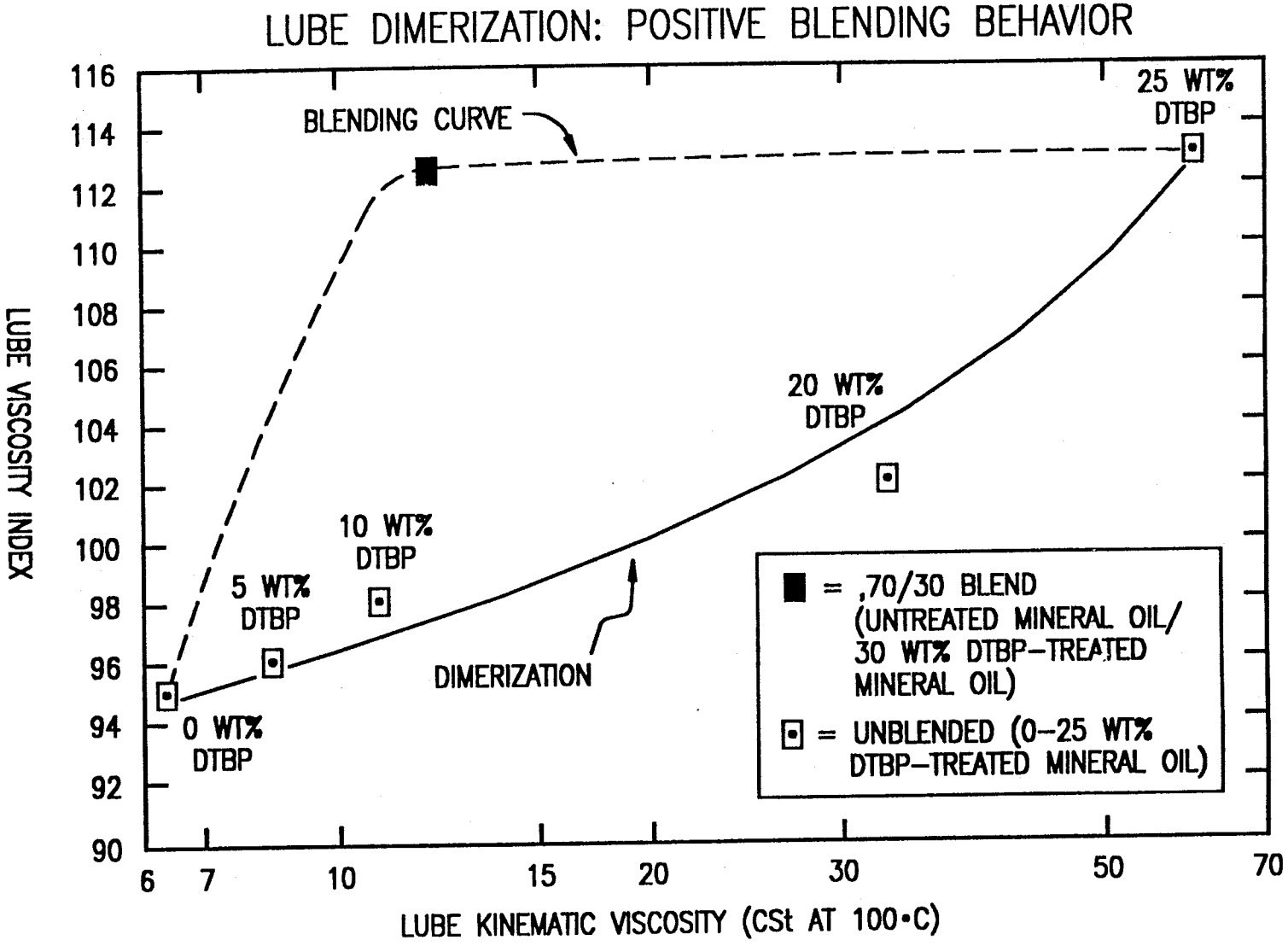
FIG. 1 is a graph showing the relationship between the viscosity properties of a light neutral mineral oil blended with 20 weight % of a light neutral mineral oil lubricant treated with 30 wt. % ditertbutyl peroxide (DTBP) and the unblended light neutral mineral oil treated with up to 30 wt. % DTBP.

The hydrocarbon feedstock used to make the lubricant products includes a broad range of hydrocarbon fractions. Suitable hydrocarbon fractions include fractions of a relatively high boiling point which are typically used as lubricant fractions. These include distillate stocks, paraffinic and naphthenic, boiling in the lubricant boiling range; that is, above about 600° F., specifically above about 650° F. and to deasphalted oils. These may include heavy distillate oils or residual fractions boiling at or above 650° F. such as cycle stocks which have, preferably, been subjected to hydrocracking. These stocks may be asphaltic or deasphalted prior to hydrocracking.

It is also possible to employ a non-lubricant fraction as the feed for the peroxide treatment step i.e. a feed boiling below the lubricant boiling range, i.e., lower than 600° F. (about 315° C.). Examples include the middle distillates boiling in the range of about 330°-650° F. (about 165°-345° C.). Fractions boiling below about 330° F. (about 165° C.) will normally not be preferred because excessive peroxide consumption is necessary to bring these naphtha range materials into the lubricant boiling range Also suitable to the invention are paraffinic hydrocarbon feedstocks. Paraffinic feedstocks include those composed of hydrocarbon chains having greater than about 3 carbon atoms, preferably from about 20 to about 60 carbon atoms which are straight chain or branched chain.

Included among suitable hydrocarbon starting materials used to make the present lubricant products are also waxy hydrocarbon fractions such as petroleum waxes, that is, waxes of paraffinic character derived from the refining of petroleum and other liquids by physical separation from a wax-containing refinery stream, by chilling the stream to a temperature at which the wax separates, by solvent dewaxing, e.g., MEK/toluene dewaxing or an autorefrigerant process such as propane dewaxing. Although the waxes will generally be derived from mineral oils other sources may be used, especially shale oil and synthetic production methods such as Fischer-Tropsch synthesis which produces highly paraffinic waxes in the high boiling fractions. These waxes have high initial boiling points above about 650° F. (about 345° C.) which render them extremely useful for processing into lubricants which also require an initial boiling point of at least 650° F. (about 345° C.). The presence of lower boiling components is not to be excluded. The lower boiling components will be moved together with higher boiling products made during the process. However, since these lower boiling components will generally reduce the final lubricant yield and, in addition, will load up the process units they are preferably excluded by distillation to a suitable cut point. The end point of the wax feed will usually be not more than about 1050° F. (about 565° C.) so that they may be classified as distillate rather than residual streams.

The paraffin content of a wax feed is high, generally at least 50, more usually at least 70, weight percent with the balance from occluded oil being divided between aromatics and naphthenics. These waxy, highly paraffinic stocks usually have much lower viscosities than neutral or residual lubricant stocks because of their relatively low aromatics and naphthenes content which are high viscosity components. The high percentage of waxy paraffins also gives them melting points and pour points which render them unacceptable as lubricants without further processing.

In one embodiment of the invention the feed may suitably be a slack wax. The slack wax, which is a solid to semi-solid product, comprising mostly highly waxy paraffins (mostly n- and mono-methyl paraffins) together with occluded oil, may be used as such or it may be subjected to an initial deoiling step of a conventional character, in order to remove the occluded oil so as to form a harder, more highly paraffinic wax which may then be passed to the hydrocracker for conversion to an acceptable lubricant oil form. The oil which is removed during the de-oiling step is highly aromatic, typically containing 30–40 percent aromatics. The deoiling step is desirable, therefore, because it removes the undesirable aromatics and heteroatoms which would otherwise increase hydrogen consumption and catalyst aging during the hydrocracking or, alternatively, would degrade the final lubricant quality if they passed through the hydrocracker.

The compositions of some typical waxes are given in Table 1 below.

TABLE 1

| Wax Composition - Arab Light Crude | | | | |
|---|---|---|---|---|
| Hydrocarbons, weight % | A | B | C | D |
| Paraffins | 94.2 | 81.8 | 70.5 | 51.4 |
| Mono-naphthenes | 2.6 | 11.0 | 6.3 | 16.5 |
| Poly-naphthenes | 2.2 | 3.2 | 7.9 | 9.9 |

TABLE 1-continued

| Wax Composition - Arab Light Crude | | | | |
|---|---|---|---|---|
| Hydrocarbons, weight % | A | B | C | D |
| Aromatics | 1.0 | 4.0 | 15.3 | 22.2 |

Wax Treatment

When the high melting point wax is employed as the feed it may first be converted into a lubricant by a number of different processes. In a preferred process, it is subjected to hydroisomerization and selective dewaxing as described in U.S. Pat. No. 5,037,528. The preferred hydroisomerization catalyst is zeolite beta and in the dewaxing step, zeolite ZSM-23 is preferably used for its highly selective dewaxing characteristics. Because the slack wax feeds are highly paraffinic, the heteroatom content is low and the wax usually may be passed directly into the hydroisomerization step over the zeolite beta catalyst, particularly if the wax has initially been de-oiled. If de-oiling is not employed, the conditions in the first, hydroisomerization step may be adjusted to increase the degree of hydrocracking so as to remove aromatic components in the occluded oil. In this case, the process conditions may be as described in U.S. Pat. No. 5,037,528 with appropriate adjustment made for the composition and content of the feed.

A wax hydrocracking/isomerization-dewaxing process may, alternatively, be employed, as described in U.S. Pat. No. 5,037,528. That is, the wax is subjected to hydrocracking/ isomerization over an amorphous catalyst which isomerizes the high pour point paraffinic component to produce iso-paraffins of low pour point and high V.I. while saturating the aromatics and opening the aromatic ring to further improve lubricant quality. The selective dewaxing step preferably uses a highly shape selective dewaxing catalyst such as ZSM-23 to remove the remaining waxy components while retaining the high V. I. isoparaffins.

A suitable dewaxing catalyst which may also be used is made up of a Group VI and/or Group VIII metal on a suitable substrate. The Group VI metal is preferably tungsten and the Group VIII metal is preferably nickel Combinations typically comprise the Group VI metal such as nickel-tungsten, nickel-molybdenum, or cobalt-molybdenum. The support for this catalyst is conventionally a porous solid of low acidity such as silica, alumina, or silica-alumina, generally of large pore amorphous character. Other porous solids which can be used include magnesia, titania or silica, either alone or mixed with alumina or silica-alumina. The catalyst can be treated with a suitable promotor such as a halide, preferably flouride.

Following the initial wax hydroisomerization or hydrocracking/isomerization, the product may still contain quantities of the more waxy straight chain, n-paraffins, together with the higher melting paraffin components. Because these contribute to unfavorable pour points, and because the effluent will have a pour point which is above the target pour point for the product, it is necessary to remove these waxy components. To do this without removing the desirable isoparaffinic components which contribute to high V.I. in the product, a selective dewaxing step is carried out. This step removes the n-paraffins together with the more highly waxy, slightly branched chain paraffins, while leaving the more branched chain iso-paraffins in the process stream. Conventional solvent dewaxing processes may be used for this purpose because they are highly selective for the removal of the more waxy components including the n-paraffins and slightly branched chain paraffins. Catalytic dewaxing processes may also be used, these processes are more highly selective for removal of n-paraffins and slightly branched chain paraffins. This step of the process can be carried out as referenced in U.S. Pat. No. 5,037,528. As generally described there, solvent dewaxing may be used or catalytic dewaxing. If catalytic dewaxing is employed, it is preferably with a selectivity greater than that of ZSM-5. Thus, catalytic dewaxing with a highly shape selective dewaxing catalyst based on a zeolite with a constraint index of at least 8 is preferred with ZSM-23 being the preferred zeolite, although other highly shape-selective zeolites such as the synthetic ferrierite ZSM-35 may also be used, especially with lighter stocks.

The dewaxing catalyst used in the catalytic dewaxing will normally include a metal hydrogenation-dehydrogenation component of the type described above; even though it may not be strictly necessary to promote the selective cracking reactions, its presence may be desirable to promote certain isomerizations which are involved in the cracking sequence, and for similar reasons, the dewaxing is normally carried out in the presence of hydrogen, under pressure. The use of the metallic component also helps retard catalyst aging in the presence of hydrogen and, may also increase the stability of the product. The metal will usually be of the type described above, i.e. a metal of Groups IB, IVA, VA, VIA, VIIA or VIIIA, preferably of Groups VIA or VIIIA, including base metals such as nickel, cobalt, molybdenum, tungsten and noble metals, especially platinum or palladium. The amount of the metal component will typically be 0.1 to 10 percent by weight, as described above and matrix materials and binders may be employed as necessary.

Shape selective dewaxing using the highly constrained, highly shape-selective zeolite catalysts may be carried out in the same general manner as other catalytic dewaxing processes, for example, in the same general manner and with similar conditions as those described above for the initial catalytic dewaxing step. Conditions will generally be of elevated temperature and pressure with hydrogen, typically at temperatures from 250° to 500° C. (about 480° F. to 930° F.), more usually 300° to 450° C. (about 570° F. to 840° F.) and in most cases not higher than about 370° C. (about 700° F.), pressures up to 25,000 kPa, more usually up to 10,000 kPa, space velocities of 0.1 to 10 $hr^{-1}$ (LHSV), more usually 0.2 to 5 $hr^{-1}$, with hydrogen circulation rates of 500 to 1000 $n.1.1^{-1}$, more usually 200 to 400 $n.1.1.^{-1}$ Reference is made to U.S. Pat. No. 5,037,528 for a more extended discussion of the catalytic dewaxing step.

If solvent dewaxing is used, the wax by-product from the solvent dewaxing may be recycled to the process to increase the total lubricant yield. If necessary, the recycled slack wax by-product may be de-oiled to remove aromatics concentrated in the oil fraction and residual heteroatom-containing impurities. Use of the solvent dewaxing with recycle of the wax to the hydroisomerization step provides a highly efficient process which is capable of providing high lubricant yields. Based on the original wax feed, the yield following the hydroisomerization-solvent dewaxing sequence is typically at least 50 volume percent and usually at least 60 volume percent or even higher, for instance, 65 volume percent, of high V. I. and low pour point lubricant. Solvent dewaxing may be used in combination with catalytic dewaxing, with an initial solvent dewaxing followed by catalytic dewaxing to the desired final pour point and recycle of the separated wax from the solvent process.

Hydrotreating

Depending upon the quantity of residual aromatics in the dewaxed lube product it may be desirable to carry out a final hydrotreatment in order to remove at least some of these aromatics and to stabilize the product. The quantity of aromatics at this stage will depend on the nature of the feed and on the processing conditions employed. If a de-oiled wax feed is used so that the aromatics are removed at the outset in the de-oiling step, the final hydrotreatment will generally be unnecessary. Similarly, if the aromatics are sufficiently removed during the first partial dewaxing step, the hydrotreatment may also be unnecessary. However, since removal of aromatics during de-oiling will generally require a more severe operation with increased paraffin cracking and a significant yield loss, it will generally be preferred to separate the aromatics in the subsequent hydrotreating step. This way the catalyst will be relatively non-acidic and cracking will be reduced.

Conventional hydrotreating catalysts and conditions are suitably used. The catalyst used is made up of a Group VI and/or a Group VIII metal on a suitable substrate. The Group VI metal is preferably tungsten and the Group VIII metal is usually nickel. Combinations typically comprise the Group VI metal such as nickel-tungsten, nickel-molybdenum or cobalt-molybdenum. Other metals which possess hydrogenation functionality are also useful. The support for the catalyst is conventionally a porous solid of low acidity such as silica, alumina or silica-alumina, generally of a large pore, amorphous character. Other porous solids which can be used include magnesia, titania or silica, either alone or mixed with alumina or silica-alumina. The catalyst can be treated with a promotor such as a halide. A preferred halide is fluoride Typical hydrotreating conditions use moderate temperatures and pressures, e.g. 290°-425° C. (about 550°-800° F.), typically 345°-400° C. (about 650°-750° F.), up to 20,000 kPa (about 3000 psig), typically about 4250-14000 kPa (about 600-2000 psig) hydrogen pressure. Because aromatics separation is desired relatively high pressures above 7000 kPa (about 1000 psig) are favored, typically 10,000-14,000 kPa (about 1435-2000 psig). Space velocities of about 0.3-2.0, typically 1 LHSV, with hydrogen circulation rates typically about 600-1000 $n.1.1^{-1}$ (about 107 to 5617 SCF/Bbl) usually about 700 $n.1.1^{-1}$ (about 3930 SCF/Bbl). The severity of the hydrotreating step should be selected according to the characteristics of the feed and of the product. The objective is to reduce residual aromatic content by saturation to form naphthenes which initially improves lube quality by removing aromatics. The objective also includes improving the color and oxidative stability of the final lube product. It may, however, be desirable to leave some aromatics in the final lubricant base stock to improve solubility for certain lubricant additives. Conversion to products outside the lubricant boiling range, i.e. below 650° F. (about 345° C.) products, will typically be no more than 10 volume percent and in most cases not more than 5 volume percent.

Hydrotreating is unnecessary when Fischer-Tropsch waxes as described in U.S. Pat. No. 4,594,172 are used as a feedstock. The process of the present invention does not require such a pure feedstock, and can tolerate very well the modest amounts of sulfur and nitrogen which are present in the slack wax fractions after a wax hydroisomerization process using either zeolite beta or an amorphous catalyst.

Typical slack wax feeds to the process of the present invention will contain an excess of 10 ppm nitrogen, and more than 0.01 wt. % sulfur. Many feedstocks contemplated for use herein will contain more than 20, more than 30, or even more than 50 ppm nitrogen, and more than 0.05, or even more than 0.1 wt. % sulfur.

The wax hydroisomerization treatment (whether using zeolite beta or an amorphous catalyst) will reduce significantly the sulfur and nitrogen content of the oil, but not eliminate it. Typically, low pressure zeolite beta wax hydroisomerization will reduce sulfur and nitrogen contents by 10–90%, preferably by 30–80%.

High pressure wax hydroisomerization over amorphous catalyst will usually reduce sulfur and nitrogen contents by 50–100%, and preferably by 60–95%.

One of the incidental advantages of the process of the present invention is that by conducting the wax isomerization step first, followed by peroxide treatment, the sulfur and nitrogen levels of the paraffinic feeds are reduced to levels which can be tolerated in the peroxide coupling step which will be discussed at greater length.

The process of the present invention tolerates a modest amount of aromatics in the stock. Typically the wax feeds to the hydroisomerization process of the present invention will contain 1–20 wt. % aromatics. After hydroisomerization, and even after the optional hydrotreating step discussed above, the feedstocks of the present invention may contain 1–40 wt. % cyclics, and preferably contain 10–25 wt. % cyclics. The cyclics will be primarily naphthenic if a high pressure hydrotreating step has been employed, and primarily aromatic if no high pressure hydrotreating, or high pressure wax isomerization, processing of the feedstock has been undertaken.

Peroxide Treatment

The hydrocarbon lubricant feedstock is treated with an organic peroxide compound at elevated temperatures. Peroxide treatment facilitates coupling between the paraffinic components (paraffin molecules and alkyl side chains on ring compounds) to increase the viscosity of the lubricant.

The preferred class of peroxides which are used include the ditertiary alkyl peroxides represented by the formula $ROOR^1$ where R and $R^1$ are the same or different tertiary alkyl radicals, preferably lower ($C_4$ to $C_6$) tertiary alkyl radicals. Suitable peroxides of this kind include ditertiary butyl peroxide, ditertiary amyl peroxide, tertiary butyl and tertiary amyl peroxide. Other organic peroxides may also be used including dialkyl peroxides with one to ten carbon atoms such as dimethyl peroxide, diethyl peroxide, dipropyl peroxide, di-n-butyl peroxide, dihexyl peroxide and acetylperoxides such as dibenzoylperoxide.

The amount of peroxy compound used in the process is determined by the target viscosity. Because there is essentially an exponential relationship between the proportion of peroxide used and the viscosity increase, both with batch and continuous reaction; in general, the increase in viscosity is related to the amount of peroxide used with greater viscosity increases resulting from greater amounts of peroxide. As a general guide, the amount of peroxide catalyst employed will be from 1 to 50, preferably from about 2 to about 30 weight percent of the oil. For purposes of lubricant blending, in accordance with the invention an excess amount of peroxide is employed to produce a starting lubricant of higher viscosity than the target viscosity of the finished, blended product. Thus, the amount of peroxide will preferably range from about 1 to about 50 wt. %, preferably about 5 to 30 wt. %, based on the entire weight of the oil.

In one embodiment of the invention where the feed is a catalytically dewaxed lubricant the presence of hydrogen due to dewaxing processes may hinder peroxide utilization slightly but significant increases in viscosity may still be obtained without other lubricant properties (pour point, V.I.) being significantly affected. It would therefore be practicable to cascade the effluent from a catalytic hydrodewaxing/hydrotreating unit directly to a peroxide treatment reactor, permitting the hydrogen to remain in the stream. The coupling of paraffinic components out of the lubricant boiling range would, in this case, increase lubricant yield and for this reason may represent a preferred embodiment of the process.

The reaction between the lubricant component and the peroxide is carried out at elevated temperature, suitably at temperatures from about 50° C. to about 300° C. and in most cases from 100° C. to about 200° C. The treatment duration will normally be from about 1 hour to 6 hours but there is no fixed duration since the different starting materials will vary in their reactivity and amenability to coupling by this method. The pressure employed will depend upon the temperature used and upon the reactants and, in most cases, needs to be sufficient only to maintain the reactants in the liquid phase during the course of the reaction. Space velocity in continuous operation will normally be from 0.25 to 5.0 LHSV ($hr^{-1}$).

The peroxide is converted during the reaction primarily to an alcohol whose boiling point will depend upon the identity of the selected peroxide. This alcohol by-product may be removed during the course of the reaction by simple choice of temperature and pressure and accordingly temperature and pressure may be selected together to ensure removal of this by-product. The alcohol may be converted back to the peroxide in an external regeneration step and recycled for further use. If ditertiary butyl peroxide is used the tertiary butyl alcohol formed may be used directly as a gasoline octane improver or, alternatively, it may be readily converted back to the original di-tertiary butyl peroxide by reaction with butyl hydro-peroxide in the presence of a mineral acid, as referenced in U.S. Pat. No. 5,037,528, with the butyl hydroperoxide being obtained by the direct oxidation of isobutane.

The reaction may be carried out batchwise or continuously and in either case it is preferable to inject the peroxide compound incrementally so as to avoid exotherms and the production of lower quality products associated with high reaction temperatures. If the reaction is carried out in a continuous tubular reactor it is preferable to inject the peroxide compound at a number of points along the reactor to achieve the desired incremental addition.

The effect of the peroxide treatment is principally to increase the viscosity of the lubricant without affecting a significant reduction in viscosity index, and particularly with the wax feeds, without significant increases in pour point or cloud point. The increase in viscosity implies an increase in molecular weight while the relatively constant pour point suggests that the reaction products are isoparaffinic in nature. It is thought that the action of the peroxide is by the removal of hydrogen atoms to form free radicals in non-terminal positions which then combine with each other to form branched chain dimers which are capable of reacting even more rapidly than the monomer. Thus, the viscosity of the treated material increases rapidly in the presence of additional amounts of peroxide which generate new free radicals. The greater reactivity perceived with the initial dimer may be attributed to reactive tertiary hydrogens which are present in the dimers and higher reaction products but not on the paraffins present in the starting material. The greater reactivity of the dimers indicates that the incremental addition of successively smaller amounts of peroxide, particularly in continuous tubular reactor synthesis, will produce relatively greater progressive increases in viscosity and will also ensure that the range of molecular weights in the product will be narrower and that product quality will be more consistent.

The coupled products may include very small amounts of olefins and in order to improve the stability of the final lube products, the peroxide-treated products may be subjected to mild hydrotreating to saturate any lube range olefins. Treatment over a conventional hydrotreating catalyst such as Co/Mo on alumina at mild temperatures typically to 500° F. (260° C.) at relatively low hydrogen pressures, typically up to 1000 psig (7000 kPa) will normally be satisfactory. At low hydrotreat temperatures up to about 550° F. (290° C.) viscosity loss on hydrotreating is minimal although greater losses may be observed at higher temperatures. Pour point and V.I. remain relatively constant with temperature.

BLENDING EFFECT

The peroxide treatment is exceedingly efficient in its use of the peroxide compound and the efficiency is put to further advantage by lubricant blending. The unexpected enhancement in viscosity achieved by blending the peroxide treated lubricant with a lower viscosity lubricant was realized by comparing the predicted viscosity with the actual viscosity.

As stated above, the ASTM D 341-87 standard has been relied on to predict the blending properties and is based on equation described above. Although the ASTM standard refers to a two part blend, the scope of this invention is by no means limited to a two component blended oil as the unexpected results observed will be observed in a multi-part blend in which at least one part is a peroxide-treated lubricant.

The lubricant blending ratio can vary substantially, and depends on the acceptable or target viscosity of the product; however, in terms of percentages of peroxide treated oil to untreated oil the ratio, in terms of weight percent of peroxide-treated oil to untreated oil, ranges from about 1 wt. % to 99 wt. % of the treated lubricant with from 99 wt. % to 1 wt. % of the untreated lubricant. More specifically, the amount ranges from 5 to 95 wt. % of the treated lubricant with from 95 to 5 wt. % of the untreated lubricant and even more specifically, from 10 wt. % to 50 wt. % of the treated lubricant to about 50 to 10 wt. % of the untreated lubricant.

EXAMPLE 1

This example illustrates the unexpected enhanced viscosity results of blending a peroxide treated mineral oil lubricant with a commercial conventional light neutral lubricant with a 6.2 cSt kinematic viscosity and a viscosity index of 95.

A conventional light neutral lubricant (6.2 cSt, 95 VI) was reacted with di-tertiary butyl peroxide. The reaction conditions were 100 psig total pressure $N_2$, 300° F. reaction temperature and 6 hours residence time with a varying peroxide dosage, in weight %. The peroxide dosages were varied by 5 wt. %, 10 wt. %, 20 wt. % and 25 wt. % to produce lubricants with different viscosities. The product viscosity increased with increasing peroxide dosage as shown in Table 1.

TABLE 1

| | Peroxide-Treated Lubricant | | | | |
|---|---|---|---|---|---|
| | Light Neutral | DTBP-Treated | | | |
| Lubricant | 0 | 5 | 10 | 20 | 25 |
| DTBP, wt. % | | | | | |
| Properties | | | | | |
| Pour Point | 10 | 10 | 5 | 0 | 0 |
| KV @ 100° C., cSt. | 6.25 | 8.4 | 12.32 | 31.42 | 60.22 |
| VI | 95 | 96 | 98 | 102 | 113 |

The results of lubricant blending in accordance with the invention were evaluated by blending the lubricant treated with the highest peroxide dosage (25 wt. %) with the untreated lubricant to achieve a blended lubricant containing 30% of the treated lubricant and 70% of the untreated lubricant.

The observed and calculated viscosities and VI of the blend composed of 70 wt. % light neutral lubricant and 30 wt. % of the 25 wt % DTBP-treated lubricant are presented in Table 2.

TABLE 2

Actual and Calculated Viscosity and VI Properties Of a 70/30 Blended Lubricant

| | Actual | ASTM D 341-87 | Calculated Average |
|---|---|---|---|
| KV @ 100° C., cSt | 11.10 | 10.62 | — |
| VI | 113 | 101 | 100.4 |

FIG. 1 is a plot of the unblended peroxide-treated lubricant, represented by the solid line and the blended lubricant, represented by the dotted line. The blend exhibits the enhanced kinematic viscosity and viscosity index over the unblended peroxide treated lubricant.

FIG. 1 shows the reduced peroxide requirement necessary to achieve the enhanced viscosity properties. At a peroxide-treatment of 7.5 wt. %, for the entire blended lubricant, the kinematic viscosity was 11.1 cSt @100° C. and the viscosity index was 113. By contrast, the peroxide requirement necessary to increase the kinematic viscosity tc the target value for the unblended lubricant would have been about 9.5 wt. % peroxide. Thus, the invention offers a reduction in the overall peroxide requirements.

Extra High Viscosity Index (XHVI) Lubricant Blend

The blending scheme of the instant invention is similarly efficient and successful with a hydroisomerized wax lubricant.

In a preferred embodiment the relatively expensive, and potentially low yield, wax isomerization step is conducted first. The hydroisomerized paraffins are then given a peroxide treatment.

Because the starting material for peroxide treatment is a relatively highly branched paraffinic product, the product of the peroxide treatment is also a highly branched paraffinic product which is an excellent extra high viscosity index (XHVI) lubricant stock.

The following examples demonstrate the production of dewaxed lubricants.

EXAMPLE 2

This Example illustrates the dewaxing of a hydrocracked wax derived lubricant over a ZSM-5 dewaxing catalyst.

The XHVI lube having the properties described in Table 1 was hydrodewaxed over 0.39 wt % Pd/ZSM-5, in a microunit at 400 psig, 1 LHSV, 2500 SCF H2/bbl, 500° F., (2860 kPa, 445 n.1.1.$^{-1}$ $H_2$, 260° C.) giving a 67 wt % yield of 650° F. + product. 41 g of the stock was placed in a 500 ml round bottom flask equipped with a stirrer, thermometer, water condenser, condenser liquid take-off and dropping burette. The flask was heated to 150° C. and 8 g of DTBP was added dropwise from the burette over a 1 hour period. The temperature was held at 150° C. for an additional 3 hours then raised to about 185° C. in the next 2 hours. The contents were then cooled to room temperature, and topped, first at atmospheric pressure to a pot temperature of 300° C., then under a vacuum of 0.1 mm pressure to a pot temperature of 190° C. to remove any DTBP decomposition products not condensed in the take-off during the reaction period. The results are shown in Table 3.

TABLE 3

| | Charge Stock | |
|---|---|---|
| Lube Yield, wt % | | 100.5 |
| Lube Properties | | |
| Gravity, | | |
| °API | 38.7 | 35.7 |
| Specific | 0.8314 | 0.8463 |
| Pour Point, °F. (°C.) | −65 (*−54) | −65 (−54) |
| K.V. @ 40° C., cs | 27.62 | 77.53 |
| K.V. @ 100° C., cs | 5.31 | 11.04 |
| SUS @ 100° F. (38° C.) | 142 | 398 |
| SUS @ 210° F. (99° C.) | 44.0 | 64.0 |
| Viscosity Index | 127.8 | 131.2 |

*less than

This is another example of hydrodewaxing over ZSM-5, using palladium instead of nickel, before reaction with DTBP.

EXAMPLE 3

The XHVI lube of Example 2 was hydrodewaxed over 1 wt % Pt/ZSM-23 in a microunit at 400 psig, 1 LHSV, 2500 SCF $H_2$/bbl, 695° F., (2860 kPa, 1 hr$^{-1}$, 445 n.1.1$^{-1}$ $H_2$, 369 ° C.), giving an 81 wt % yield of 650° F. + product. A 50 g portion of this was reacted with 10 g DTBP as described in Example 2, with the results shown in Table 4:

TABLE 4

| | Charge Stock | |
|---|---|---|
| Lube Yield, wt % | | 100.8 |
| Lube Properties | | |
| Gravity | | |
| °API | 38.9 | 35.5 |
| Specific | 0.8304 | 0.8473 |
| Pour Point, °F. (°C.) | −65 (*−54) | *−65 (*−54) |
| K.V. @ 40° C., cs | 24.67 | 78.25 |

TABLE 4-continued

| | Charge Stock | |
|---|---|---|
| K.V. @ 100° C., cs | 5.05 | 11.52 |
| SUS @ 100° F. (38° C.) | 127 | 401 |
| SUS @ 210° F. (99° C.) | 43.2 | 65.7 |
| Viscosity Index | 136.0 | 139.3 |

*less than

EXAMPLE 4

This Example illustrates the preparation of a hydroisomerised-dewaxed lube from slack wax with peroxide treatment of the dewaxed product. Heavy neutral slack wax was first processed over 0.6 wt % Pt/Zeolite beta catalyst in a pilot plant run at 400 psig, 1.3 LHSV, 2000 SCF $H_2$/bbl, 745° F., (2860 kPa, 1.3 hr$^{-1}$, 365 n.1.1.$^{-1}$ $H_2$, 395° C.), and the 650° F. + bottoms product solvent dewaxed using MEK/toluene to +10° F. pour point, overall yield 51 wt %. A 100 g portion, 650° F. +, was reacted with 20 g DTBP as described in Example 2, with the results shown in Table 5.

TABLE 5

| | Charge Stock | |
|---|---|---|
| Lube Yield, wt % | | 100.4 |
| Lube Properties | | |
| Gravity, | | |
| °API | 37.5 | 33.3 |
| Specific | 0.8373 | 0.8586 |
| Pour Point, °F. (°C.) | +10 (−12) | +10 (−12) |
| K.V. @ 40° C., cs | 32.44 | 101.2 |
| K.V. @ 100° C., cs | 6.205 | 14.19 |
| SUS @ 100° F. (38° C.) | 166 | 520 |
| SUS @ 210° F. (99° C.) | 47 | 76.2 |
| Viscosity Index | 143.5 | 143.3 |

EXAMPLE 5

Heavy neutral slack wax was first deoiled, then processed over 0.6 wt % Pt/zeolite Beta catalyst in a pilot plant run at 400 psig, 1.3 LHSV, 2000 SCF H2/bbl, 750° F., (2860 kPa, 1.3 hr$^{-1}$, 356 n.1.1.$^{-1}$ $H_2$, 375° C.), and the 650° F. + product solvent dewaxed using MEK/toluene to a +5° F. pour, overall yield 30 wt %. A 100 g portion, 650° F. +, was reacted with 20 g DTBP as described in Example 2, with the results shown in Table 6.

TABLE 6

| DTBP Treatment of XHVI Slack Wax-Derived Charge Stock | | |
|---|---|---|
| Lube Yield, wt % | | 101.2 |
| Lube Properties | | |
| Gravity, | | |
| °API | 37.5 | 35.6 |
| Specific | 0.8373 | 0.8468 |
| Pour Point, °F. (°C.) | +5 (−15) | +5 (−15) |
| K.V. @ 40° C., cs | 26.60 | 83.16 |
| K.V. @ 100° C., cs | 5.59 | 13.00 |
| SUS @ 100° F. (38° C.) | 136 | 424 |
| SUS @ 210° F. (99° C.) | 44.9 | 71.4 |
| Viscosity Index | 156.0 | 156.7 |

This Example demonstrates the very high viscosity index obtainable by first deoiling the wax.

EXAMPLE 6

This Example demonstrates that hydrocracked wax can be hydrodewaxed directly, eliminating the intermediate solvent dewaxing step, before reaction with DTBP.

Slack wax was first processed over a commercial Ni/W/Al/F catalyst containing of 4.6 wt % Ni, 22.8 wt % W, with addition of 25 ppm F as O-fluorotoluene in the feed, in a pilot plant run at 2000 psig, 0.8 LHSV, 2500 SCF $H_2$/bbl, and 775° F., (13890 kPa, 0.8 $hr^{-1}$, 445 n.l.l.$^{-1}$, $H_2$, 413° C.) giving a 72 wt % yield of 610° F. + product having a pour point of +120° F. This product was then hydrodewaxed over 0.5 wt % Pt/ZSM-23 in a microunit run at 400 psig, 1 LHSV, 2500 SCF $H_2$/bbl, 630° F., (2860 kPa, 1 $h^{-1}$, 445 n.l.l.$^{-1}$ $H_2$, 330° C.) giving a 60 wt % yield of 610° F. + product having a pour point of +10° F. (overall yield, based on wax charge, 43 wt %). A 50 g portion was reacted with 10 g DTBP as described in Example 2, with the results shown in Table 7.

TABLE 7

| DTBP treatment of Wax Derived Lube Charge Stock | | |
|---|---|---|
| Lube Yield, wt % | | 101.5 |
| Lube Properties | | |
| Gravity, | | |
| °API | 8.8 | 35.7 |
| Specific | 0.8309 | 0.8463 |
| Pour Point, °F. (°C.) | +10 (−12) | +20 (−7) |
| K V. @ 40° C., cs | 27.35 | 82.28 |
| K.V. @ 100° C., cs | 5.43 | 12.25 |
| SUS @ 100° F. (38° C.) | 141 | 421 |
| SUS @ 210° F. (99° C.) | 44.1 | 68.5 |
| Viscosity Index | 138.2 | 144.8 |

EXAMPLE 7

This Example illustrates the peroxide treatment of a dewaxed middle distillate. A heavy neutral slack wax having the properties set out in Table 8 was hydroisomerized over zeolite beta and solvent dewaxed as described in Example 4.

TABLE 8

| Heavy Neutral Slack Wax | |
|---|---|
| Gravity, | |
| °API | 35.8 |
| Specific | 0.8458 |
| Hydrogen, wt % | 14.11 |
| Sulfur, wt % | 0.082 |
| Nitrogen, ppm | 33 |
| KV @ 100° C., cs | 8.515 |
| Oil Content, wt % | 14.15 |

The 330° -650° F. fraction from the hydroisomerization step was obtained in a yield of 23.0 wt % and its properties were as set out in Table 9.

TABLE 9

| Hydroisomerized 330°-650° F. Fraction | |
|---|---|
| Gravity, | |
| °API | 50.3 |
| Specific | 0.7783 |
| Pour Point, °F. (°C.) | −65 (−54) |
| Hydrogen, wt % | 15.26 |
| Bromine No. (D-1159) | 0.0 |
| Boiling Range, °F. (D-2887) | |
| 1% | 314 |
| 5 | 333 |
| 10 | 355 |
| 30 | 416 |
| 50 | 475 |
| 70 | 541 |
| 90 | 617 |
| 95 | 640 |
| 99 | 660 |

TABLE 9-continued

| Hydroisomerized 330°-650° F. Fraction | |
|---|---|
| Mol. Wt. (Calc.) | 220 |

The bromine number indicates that the fraction does not contain olefinic compounds, and the hydrogen content indicates that it is essentially all paraffinic (average carbon No 15, calculated 15.31 wt % H).

The process is efficient both in its use of chargestock and its use of peroxide compound. The paraffinic feedstock is hydroisomerized first, and then given a peroxide treatment. By peroxide treating a hydroisomerized wax (as opposed to using peroxide treatment to couple waxes and make extremely long chain waxes) essentially stoichiometric yields of XHVI lube components are obtained from the peroxide treatment step. Such yield losses as occur during the hydroisomerization step (and using Pt on an amorphous support gives relatively low yields of hydroisomerized oil), are limited to the hydroisomerization reactor.

The process of the present invention permits efficient conversion of waxy feeds to XHVI oils, by the steps of hydroisomerization and peroxide treatment followed by blending.

USING WAX-DERIVED LUBRICANTS FOR LUBRICANT BLENDING

EXAMPLE 8

This example illustrates the enhancement in viscosity by formulating a blended lubricant in which one of the blending components is a peroxide treated hydroisomerized wax lubricant.

An XHVI lubricant stock was made from a Pt zeolite beta wax hydroisomerization process using a heavy neutral deoiled wax feedstock. The feedstock was reacted with DTBP. The reaction conditions were 100 psig total pressure $N_2$, 300° F. reaction temperature and 6 hours residence time with a varying peroxide dosage which ranged from 10 wt. %, 20 wt. %, 25 wt. % and 30 wt. %. The lubricant viscosity increased from 5.5 cSt at 100° C. to 254.9 cSt at 100° C. at a 30 wt. % peroxide dosage. A corresponding viscosity index increase from 156 to 242 was also achieved.

The properties of XHVI lubricant basestock as a function of the amount of DTBP used are shown in the following Table:

TABLE 10

| | Properties of Unblended Lubricant | | | | |
|---|---|---|---|---|---|
| | XHVI Lubricant | DTBP-Treated XHVI Lubricant | | | |
| DTBP, wt. % | 0 | 10 | 20 | 25 | 30 |
| Properties | | | | | |
| Pour Point, °F. | 5 | 5 | 0 | −5 | −5 |
| KV@ | | | | | |
| 40° C., cSt. | 26.4 | 62.81 | 184.5 | 610.11 | 2566 |
| 100° C., cSt. | 5.567 | 10.52 | 24.35 | 69.59 | 254.6 |
| SUS@ 100° F. | 136 | 320 | 948 | 3,149 | 13,291 |
| VI | 156 | 158 | 163 | 192 | 242 |

The observed viscosity and VI compared to the calculated viscosity and VI of blended lubricants made from an XHVI lubricant and an XHVI lubricant treated with 30 wt. % DTBP is shown in Table 11.

TABLE 11

Actual and Calculated Properties of Blended XHVI Lubricants

| | XHVI Lubricant | Blended Lubricant | | | 30% DTBP-Treated XHVI Lubricant |
|---|---|---|---|---|---|
| Wt. % Blending of | | | | | |
| XHVI | 100 | 90 | 80 | 50 | 0 |
| DTBP-Treated | 0 | 10 | 20 | 50 | 100 |
| Actual Properties | | | | | |
| Pour Point, °F. | 5 | 10 | 10 | 0 | −5 |
| KV @ | | | | | |
| 40° C., cSt | 26.40 | 45.71 | 77.31 | 326.1 | 2566 |
| 100° C., cSt | 5.567 | 9.01 | 14.27 | 49.21 | 254.6 |
| VI | 156 | 183 | 193 | 215 | 242 |
| Calculated Properties: | | | | | |
| ASTM D-341-81 | | | | | |
| KV @ | | | | | |
| 40° C., cSt | — | 42.57 | 68.61 | 281.6 | — |
| 100° C., cSt | — | 8.088 | 11.801 | 37.32 | — |
| VI | — | 167 | 169 | 183 | — |
| Average (weighted) | | | | | |
| VI | — | 164.6 | 173.2 | 199 | — |

Figure 2:
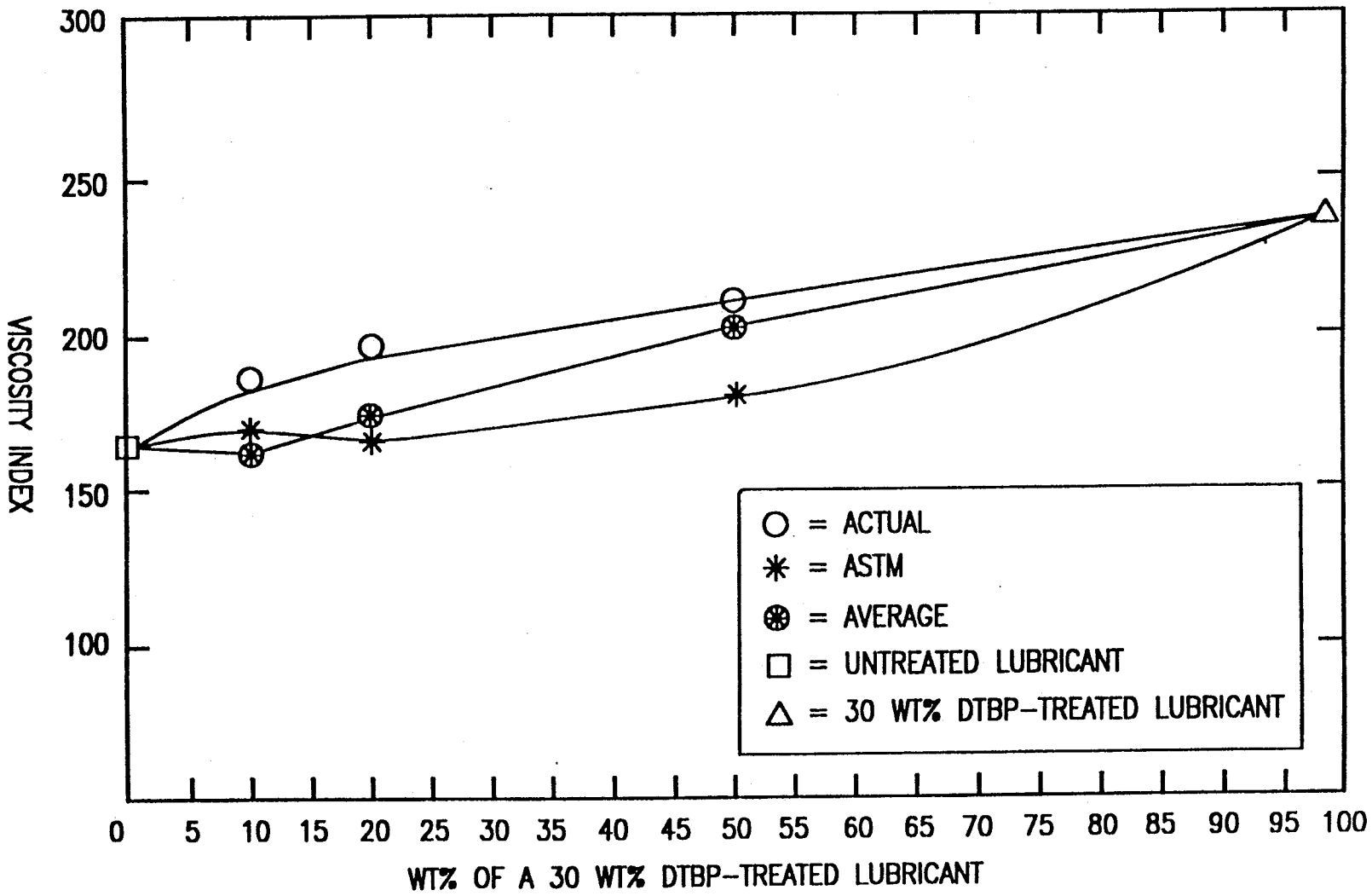
FIG. 2 is a plot of VI of a lubricant blend vs. wt. % DTBP-treated lubricant used in the blend. This plot also shows the actual VI, the VI based on the ASTM D 341-87 calculated viscosity and average VI of the blend at increasing dosages of a 30 wt. % DTBP-treated lubricant.

FIG. 2 is a plot of the VI v. the wt. % of a 30 wt. % DTBP-treated lubricant. FIG. 2 shown the synergistic effect of blending on VI as compared to the VI calculation by the ASTM method D 341-87 or the average of the VI based on the proportion of each component of the blend.

Figure 3:
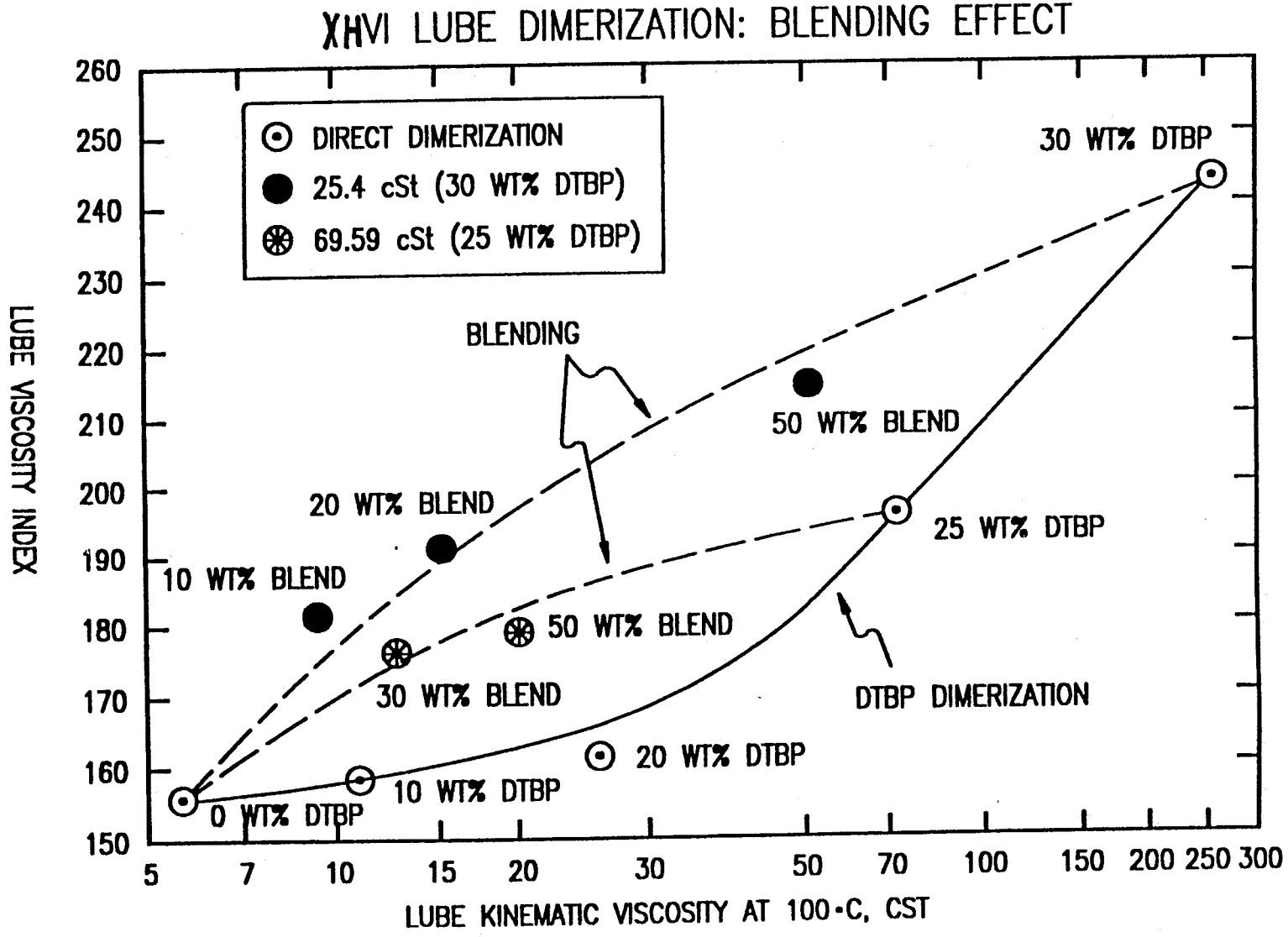
FIG. 3 is a graph showing the relationship between the viscosity properties of two blended wax hydroisomerate lubricants containing various dosages of a peroxide treated wax hydroisomerate blending component.

FIG. 3 shows the significantly enhanced VI and viscosity of the blend as compared to the unblended lubricant, as the proportion, in terms of wt. %, of DTBP increases. Surprisingly, blending produces a lubricant with a much higher product VI than the unblended lubricant made by direct peroxide treatment to achieve a target viscosity. This means that a lower overall peroxide dosage can be used to make the target viscosity product. For example, to achieve a target VI of about 190 at a kinematic viscosity of 70 cSt. @100° C. by direct peroxide treatment 25 wt. % of peroxide was required. By contrast, the blended lubricant achieved a VI of about 190 and kinematic viscosity of about 50 cSt. @100° C. by using only 20 wt. %, based on the entire weight of the lubricant blend, of a high VI lubricant which was treated with 30 wt. % of the peroxide. Thus, the blend only contained about 6 wt. % of peroxide to achieve about the same results as the unblended peroxide-treated lubricant.

EXAMPLE 9

This example is a sample calculation for determining the kinematic viscosity and VI of the blend of Example 8 according to the ASTM D 341-87 method and the ASTM D2270-86 method. The calculation is based on the blend, in terms of wt. %, of untreated lubricant :30 wt. % peroxide treated lubricant of 80:20 or in terms of vol. %, 19.4:80.6.

| | Low Viscosity Oil Untreated Oil Component L | High Viscosity Oil Peroxide-treated Oil Component H |
|---|---|---|
| KV @ 40° C., cSt. | 26.40 | 2566.0 |
| KV @ 100° C., cSt. | 5.567 | 254.6 |

-continued

| | Low Viscosity Oil Untreated Oil Component L | High Viscosity Oil Peroxide-treated Oil Component H |
|---|---|---|

$$X = \left[\frac{(E - A)(C - D)}{(E - F)(A - C)} + 1\right]^{-1}$$

where

X= volume fraction of high viscosity oil (19.4 vol. %)

A= log log Z= log log (KV @40° C.+0.7)

B= log log Z= log log (KV @100° C.+0.7)

C= log log (26.4+0.7)=0.1562

D= log log (5.567+0.7)=−0.0985

E= log log (2566+0.7)=0.5327

F= log log (254.0+0.7)=0.3815

$$0.194 = \left[\frac{(0.5327 - A)(0.1562 + 0.0985)}{(0.5327 - 0.3815)(A - 0.1562)} + 1\right]^{-1}$$

A= log log Z= log log (cST @40° C.+0.7)=0.2650 calculated KV @40° C.=68.61

$$X = \left[\frac{(F - B)(C - D)}{(E - F)(B - D)} + 1\right]^{-1}$$

solving for B:

$$0.194 = \left[\frac{(0.3815 - B)(0.1562 + 0.0985)}{(0.5327 - 0.3815)(B + 0.0985)} + 1\right]^{-1}$$

B= log log Z= log log (cST @100° C.=0.7)=0.0402 calculated KV @100° C.=11.801.

To calculate the VI the procedure for oils of VI of 100 and greater was used from the ASTM D2270-86 method.

$$VI = \left[\frac{(\text{antilog } N) - 1)}{0.00715}\right] + 100$$

where:

$$N = \frac{(\log H - \log U)}{\log Y}$$

where

U= kinematic viscosity, in cST ($mm^2/s$), at 40° C. of the oil whose VI is to be calculated;

Y= kinematic viscosity, in cSt ($mm^2/s$), at 100° C. of the oil whose kinematic viscosity is to be calculated; and H= kinematic viscosity, in cSt ($mm^2/s$), at 40° C. of an oil of 100 VI having the same kinematic viscosity at 100° C. as the oil whose VI is to be calculated.

KV @100° C. =11.80, therefore H=105.4 (from Table 1) of ASTM D2270.

KV @40° C. =68.61

$$N = \frac{\log 105.4 - \log 68.61}{\log 11.8} = 0.1739$$

$$VI = \left[\frac{(\text{antilog } 0.174) - 1}{0.00715}\right] + 100 = 168.8980 = 169$$

EXAMPLE 10

This example is a sample calculation for determining the actual VI using ASTM D-2270-86 of the blend of Example 8. The calculation is based on the actual measured kinematic viscosities of the blend, in terms of weight %, of untreated lubricant: 30 wt. % peroxide treated lubricant of 80:20, used in the sample calculation of Example 9.

using Equations 1 and 2 of Example 9.

Y=KV @100° C. =14.27;

H=139.2 (from Table 1 of ASTM D-2270-86); and

U=77.31

$$N = \frac{(\log 139.2 - \log 77.31)}{\log 14.27} = 0.2212$$

$$VI = \left[\frac{(\text{antilog } 0.222) - 1}{0.00715}\right] + 100 = 192.9130 = 193$$

EXAMPLE 11

The 30 wt. % DTBP-treated hydroisomerized wax lubricant of Example 8 was blended with a light neutral mineral oil. The actual and calculated results of the blending are presented in Table 12.

TABLE 12

| | Actual and Calculated Viscosity and VI Properties of Blended Lubricant | | | |
|---|---|---|---|---|
| | Light Neutral Mineral Oil | Blended Lubricant 1 | Blended Lubricant 2 | 30% DTBP-Treated XHVI Lubricant |
| Wt. % Blending | | | | |
| Light Neutral Oil | 100 | 80 | 90 | 0 |
| DTBP-Treated Oil | 0 | 20 | 10 | 100 |
| Actual Properties | | | | |
| Pour Point, °F. | 15 | 10 | 15 | −5 |
| KV @ | | | | |
| 40° C., cSt | 41.54 | 129.37 | 73.71 | 2566 |
| 100° C., cSt | 6.231 | 17.82 | 10.59 | 254.6 |
| VI | 95 | 153 | 130 | 242 |
| Calculated Properties: | | | | |
| ASTM D-341-81 | | | | |
| KV @ | | | | |
| 40° C., cSt | — | 116.05 | 70.41 | — |
| 100° C., cSt | — | 14.53 | 9.57 | — |
| VI | — | 127 | 115 | — |
| Average (weighted) | | | | |
| VI | — | 124.4 | 109.7 | — |

What is claimed is:

1. A process for making a blended lubricant of enhanced viscosity index (VI) comprising the steps of:

treating a first lubricant boiling range material with about 10 to about 30 wt. % of an organic peroxide sufficient to increase the viscosity index of the lubricant boiling range material;

blending from about 5 to 95 wt. % of the peroxide-treated lubricant boiling range material with from about 95 to 5 wt. % of a second non-peroxide treated lubricant boiling range material to produce a blended lubricant having a higher viscosity index than predicted by calculating the viscosity index using an ASTM standard method designated D 341-87 and by calculating the average of the VI based on the proportion of each component of the blend and wherein the blended lubricant contains a lower peroxide dosage than the peroxide-treated lubricant treated with an amount of peroxide sufficient to achieve the same VI as that of the blended lubricant.

2. The process as described in claim 1 in which the organic peroxide is a ditertiary alkyl peroxide.

3. The process as described in claim 2 in which the peroxide is a ditertiary butyl peroxide.

4. The process as described in claim 1 in which the lubricant boiling range material boils above 650° F.

5. The process as described in claim 1 in which the blend is made from 10 to 50 wt. % of the peroxide treated lubricant and from 50 to 10 wt. % of the second lubricant boiling range material.

6. The process as described in claim 1 in which the first and second lubricant boiling range materials are distillate stocks.

7. A process for producing a blended lubricant of enhanced viscosity index (VI) comprising the steps of:

subjecting a waxy hydrocarbon fraction to a catalytic dewaxing step by contacting the fraction under dewaxing conditions of elevated temperature and pressure in the presence of hydrogen with a dewaxing catalyst to effect a conversion of the waxy components to less waxy components, to produce a dewaxed lubricant boiling range material;

treating the dewaxed lubricant boiling range material with about 10 to about 30 wt. % of an organic peroxide to increase the viscosity index of the lubricant boiling range material; and blending the peroxide-treated dewaxed lubricant boiling range material of increased viscosity index in an amount ranging from about 5 to 95 wt. % with from about 95 to 5 wt. % of a hydrocarbon fraction boiling in the lubricant boiling range which has not been treated with peroxide to produce a blended lubricant having a higher viscosity index than predicted by calculating the viscosity index using an ASTM standard method designated D 341-87 and by calculating the average of the VI based on the proportion of each component of the blend and wherein the blended lubricant contains a lower peroxide dosage than the peroxide-treated dewaxed lubricant treated with an amount of peroxide sufficient to achieve the same VI as that of the blended lubricant.

8. The process of claim 7 in which the hydrocarbon fraction of lubricant boiling range is a dewaxed lubricant boiling range material of lower viscosity than the peroxide-treated dewaxed lubricant fraction.

9. The process as described in claim 7 in which the organic peroxide comprises a ditertiary alkyl peroxide.

10. The process as described in claim 9 in which the peroxide comprises a ditertiary butyl peroxide.

11. The process as described in claim 7 in which the blend is made from 10 to 50 wt. % of the treated dewaxed lubricant boiling range material and from 50 to 10 wt. % of the hydrocarbon fraction boiling in the lubricant boiling range.

12. The process as described in claim 7 in which the catalyst comprises zeolite beta, ZSM-5 or ZSM-23.

13. The process as described in claim 12 in which the catalyst comprises zeolite beta, ZSM-5 or ZSM-23 and a metal component having hydrogenation functionality wherein the metal is nickel, platinum or palladium.

14. The process as described in claim 7 in which the catalyst comprises a Group VI and/or a Group VIII metal on a porous substrate.

15. The process as described in claim 14 in which the Group VI metal is tungsten and the Group VIII metal is nickel.

16. The process as described in claim 14 in which the porous substrate is alumina, silica or silica-alumina.

17. The process as described in claim 14 in which the catalyst further comprises fluoride.

18. The process as described in claim 7 in which the catalyst comprises nickel-tungsten on a porous alumina substrate.

19. A process for making a blended lubricant of enhanced viscosity index (VI) comprising the steps of:

subjecting a waxy hydrocarbon fraction to a catalytic dewaxing step by contacting the fraction under dewaxing conditions of elevated temperature and pressure in the presence of hydrogen with a dewaxing catalyst to effect a conversion of the waxy components to less waxy components, to produce a dewaxed lubricant boiling range material;

treating the dewaxed lubricant boiling range material with about 10 wt. % up to about 30 wt. % of an organic peroxide to increase the viscosity index of the lubricant boiling range material; and blending the peroxide-treated dewaxed lubricant boiling range material of increased viscosity index in an amount ranging from about 5 to 95 wt. % with from about 95 to 5 wt. % with a distillate lubricant boiling range fraction which has not been treated with peroxide to produce a blended lubricant having a higher viscosity index than predicated by calculating the viscosity index using an ASTM standard method designated D 341-87 and by calculating the average of the VI base on the proportion of each component of the blend and wherein the blended lubricant contains a lower peroxide dosage than the peroxide-treated dewaxed lubricant treated with an amount of peroxide sufficient to achieve the same VI as that of the blended lubricant.

20. The process of claim 19 in which the organic peroxide is ditertbutyl peroxide.

* * * * *